US008950903B2

(12) United States Patent
Moon et al.

(10) Patent No.: US 8,950,903 B2
(45) Date of Patent: Feb. 10, 2015

(54) LED LIGHT BULB EMITTING LIGHT RAYS IN A DOWNWARD DIRECTION

(71) Applicants: Daisung Moon, Hong Kong (HK); Sangpil Moon, Hong Kong (HK)

(72) Inventors: Daisung Moon, Hong Kong (HK); Sangpil Moon, Hong Kong (HK)

( * ) Notice: Subject to any disclaimer, the term of this patent is extended or adjusted under 35 U.S.C. 154(b) by 0 days.

(21) Appl. No.: 13/859,762

(22) Filed: Apr. 10, 2013

(65) Prior Publication Data

US 2014/0204589 A1 Jul. 24, 2014

Related U.S. Application Data

(63) Continuation of application No. PCT/CN2013/070678, filed on Jan. 18, 2013.

(51) Int. Cl.

| | |
|---|---|
| ***F21V 5/00*** | (2006.01) |
| ***F21V 7/10*** | (2006.01) |
| ***F21K 99/00*** | (2010.01) |
| ***F21V 7/00*** | (2006.01) |
| *F21V 29/00* | (2006.01) |
| *F21V 3/00* | (2006.01) |
| *F21V 17/10* | (2006.01) |
| *F21V 19/00* | (2006.01) |
| *F21Y 101/02* | (2006.01) |

(52) U.S. Cl.

CPC ..... *F21V 7/10* (2013.01); *F21K 9/1355* (2013.01); *F21K 9/50* (2013.01); *F21V 7/0058* (2013.01); *F21V 29/2231* (2013.01); *F21V 3/00* (2013.01); *F21V 17/101* (2013.01); *F21V 19/0055* (2013.01); *F21Y 2101/02* (2013.01)

USPC ..... 362/311.02; 362/249.02; 362/246; 313/111; 313/495

(58) Field of Classification Search

USPC ..... 362/311.02, 311.11, 249.02, 235, 294; 313/113, 498

See application file for complete search history.

(56) References Cited

U.S. PATENT DOCUMENTS

| | | | | |
|---|---|---|---|---|
| 7,527,399 | B2 * | 5/2009 | Feiereisen | 362/342 |
| 8,157,417 | B2 * | 4/2012 | Chen | 362/256 |
| 8,226,270 | B2 * | 7/2012 | Yamamoto et al. | 362/294 |
| 8,283,844 | B2 * | 10/2012 | Cho et al. | 313/113 |
| 8,294,356 | B2 * | 10/2012 | Suwa et al. | 313/498 |

* cited by examiner

*Primary Examiner* — Ali Alavi

(57) ABSTRACT

The present invention relates to an LED light bulb emitting light rays in a downward direction comprising a lamp cap, a base, a lamp body and a lamp cover, characterized in that, a reflector assembly is arranged in the center of a spherical cavity of the lamp cover; the reflector assembly is composed of a reflector support and a reflector fastened to the reflector support; the reflector support is composed of a small-diameter upper ring, a large-diameter lower ring, a plurality of poles connecting the upper ring and the lower ring, and a fastener at the bottom of the lower ring for fastening the reflector; the reflector is composed of a trumpet-shaped milky cover and a hook fastener arranged on an inner ring surface of an opening at the bottom of the cover for fastening the fastener of the reflector support.

7 Claims, 2 Drawing Sheets

LED LIGHT BULB EMITTING LIGHT RAYS IN A DOWNWARD DIRECTION

CROSS-REFERENCE TO RELATED APPLICATIONS

This present application is a Continuation Application of PCT application No. PCT/CN2013/070678 filed on Jan. 18, 2013; the contents of which are hereby incorporated by reference.

FIELD OF THE INVENTION

The present invention relates to an LED light bulb emitting light rays in a downward direction.

BACKGROUND OF THE INVENTION

Fluorescent lamps are widely used because of their wide illuminating areas. As for LED bulbs, they have a beam angle of 120 degrees, which makes an area lighted up by the beam of LED very bright, however, the other areas in the opposite direction is badly lighted. Hence, the shortcoming of an LED light bulb is that: the lighting effects of the LED light bulb are found to be unsatisfactory when the LED light bulb is designed for a table lamp, in which the LED light bulb is vertically mounted with its bulb downward, and its emitted light rays are required to be emanated downwards.

A Chinese patent application CN201110257494.8 has disclosed an LED lamp. The object of the application is to provide an LED lamp with its illuminating areas behind and below the lamp's cap, which solves the problem of unsatisfactory lighting effects of LED lamp when the LED lamp is designed for certain luminaires, in which luminaires the LED lamp is vertically mounted with its cap downward, and its emitted light rays are required to be emanated downwards. The technical solution of the application is as follows: an LED lamp comprising a lamp cap, a light-transmission cover and a heat-transfer body, one end of the heat-transfer body being connected with the lamp cap, while the other end of the heat-transfer body being connected with a heat radiator, a mounting plane being on an surface of the heat-transfer body between the heat radiator and the lamp cap, an LED light source assembly being mounted on the mounting plane, and the LED light source assembly being covered by the light-transmission cover. However, the shortcoming of the LED lamp is that: the lighting effects of the LED lamp are found to be unsatisfactory when the LED lamp is designed for a table lamp, because the emitted light rays are emanated sideways.

SUMMARY OF THE INVENTION

The object of the present invention is to provide an LED light bulb having a reflector assembly arranged at a partial inner wall of a cambered end of a lamp cover, so as to emanate downwards most of emitted light rays after the light rays have been refracted, and at the same time to emanate some light rays upwards through a pre-reserved light channel at the center of the reflector assembly.

The present invention provides the following technical solutions. An LED light bulb emitting light rays in a downward direction comprising: a lamp cap, a base, a lamp body and a lamp cover that being successively connected together to form an integration of them, a driver board received in an inner cavity of the lamp body, an aluminum substrate and an LED light source assembly arranged on the aluminum substrate both set on a mounting plane of the lamp body, a through-hole set at the center of the aluminum substrate and a through-hole set at the center of the mounting plane of the lamp body, a closing ring of the driver board piercing through the through-holes from the inner cavity of the lamp body so as to connect wires on the driver board to the aluminum substrate, and a screw screwed into a screw hole of the base so as to connect together the aluminum substrate, the lamp body and the base, characterized in that: a reflector assembly is arranged in the center of a spherical cavity of the lamp cover.

Preferably, the reflector assembly is composed of a reflector support, and a reflector fastened to the reflector support.

Preferably, the reflector support is composed of a small-diameter upper ring, a large-diameter lower ring, a plurality of poles connecting the upper ring and the lower ring, and a fastener at the bottom of the lower ring for fastening the reflector.

Preferably, a transparent material is used for the reflector support; and three poles are provided.

Preferably, the fastener is composed of a protruding fastener which protrudes from an outer wall of the lower ring and then narrows downwards and inwards into an acute angle.

Preferably, the reflector is composed of a trumpet-shaped milky cover, and a hook fastener arranged on an inner ring surface of an opening at the bottom of the cover for fastening the fastener of the reflector support.

Preferably, the hook fastener is composed of a U-shaped piece, a groove formed within the U-shaped piece with its bottom having a shape in accordance with the shape of inner wall of the trumpet-shaped cover, and a hook formed at the top of the groove from the bottom of groove for fastening the protruding fastener therein.

Preferably, the color of the cover is milky.

Preferably, the reflector assembly is composed of a reflector support and a reflector integrally formed with the bottom of the reflector support.

The present invention also provides another technical solution as follow. An LED light bulb emitting light rays in a downward direction comprising: a lamp cap, a base, a lamp body and a lamp cover that being successively connected together to form an integration of them, a driver board received in an inner cavity of the lamp body, an aluminum substrate and an LED light source assembly arranged on the aluminum substrate both set on a mounting plane of the lamp body, a through-hole set at the center of the aluminum substrate and a through-hole set at the center of the mounting plane of the lamp body, a closing ring of the driver board piercing through the through-holes from the inner cavity of the lamp body so as to connect wires on the driver board to the aluminum substrate, and a screw screwed into a screw hole of the base so as to connect together the aluminum substrate, the lamp body and the base, characterized in that: a reflector assembly is arranged in the center of a spherical cavity of the lamp cover; the reflector assembly is composed of a reflector support and a reflector fastened to the reflector support; the reflector support is composed of a small-diameter upper ring, a large-diameter lower ring, a plurality of poles connecting the upper ring and the lower ring, and a fastener at the bottom of the lower ring for fastening the reflector; the reflector is composed of a trumpet-shaped milky cover and a hook fastener arranged on an inner ring surface of an opening at the bottom of the cover for fastening the fastener of the reflector support.

Comparing with the prior art, the advantages of the present invention are as follows: by using the LED light bulb of the present invention, downward light rays transmitting through the lamp cover have a beam angle of 240-300 degrees, at the same time, some light rays are emanated upwards through a pre-reserved light channel at the center of the reflector assembly, such that tender lighting effects are obtained.

DETAILED DESCRIPTION OF THE PREFERRED EMBODIMENTS OF THE INVENTION

Figure 1:
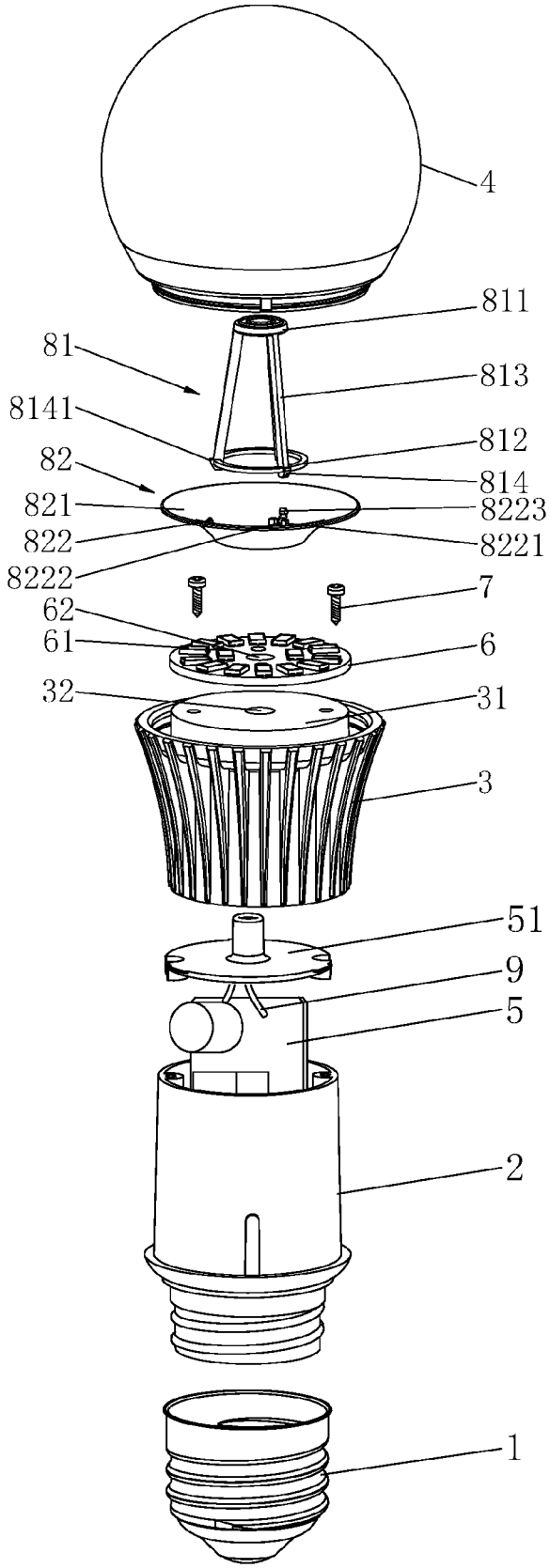
FIG. 1 is an explosive view of the LED light bulb of the present invention.
Figure 2:
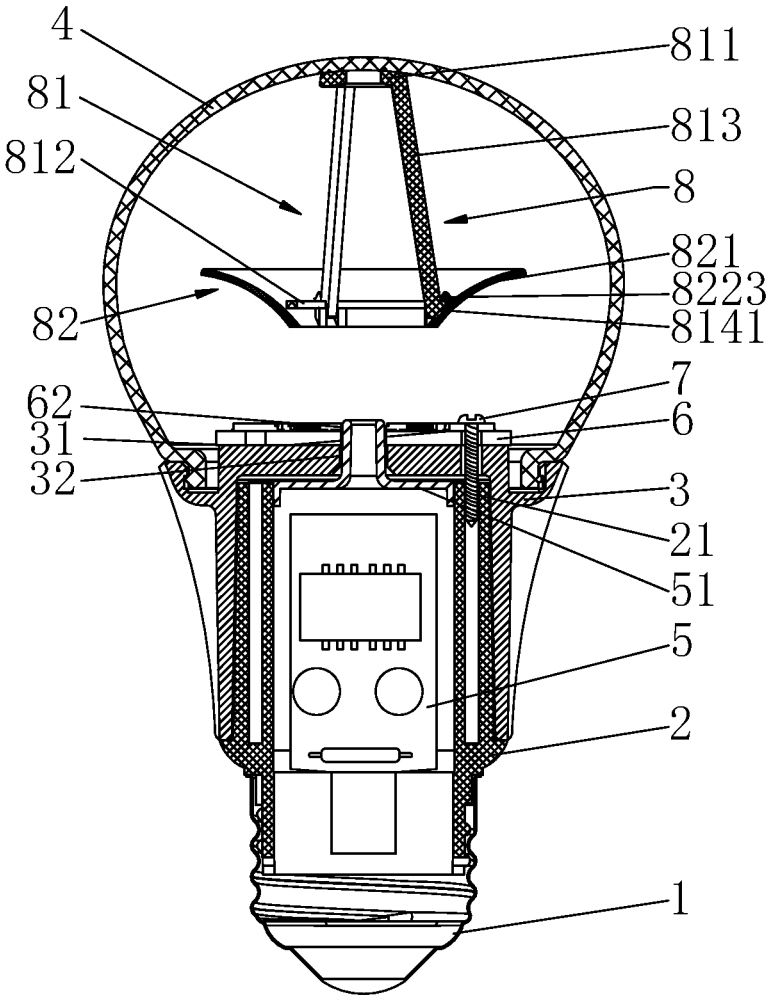
FIG. 2 is a sectional view of the LED light bulb of the present invention.

The LED light bulb of the present invention will be more fully understood and appreciated from the following detailed description, taken in conjunction with the drawings.

The drawings show that, the LED light bulb emitting light rays in a downward direction comprises a lamp cap 1, a base 2, a lamp body 3 and a lamp cover 4 that are successively connected together to form an integration of them, a driver board 5 is received in an inner cavity of the lamp body 3, radiating fins are provided by the outside of the lamp body 3, an aluminum substrate 6 and an LED light source assembly 61 arranged on the aluminum substrate 6 both are set on a mounting plane 31 of the lamp body, a through-hole 62 penetrating through the aluminum substrate and a through-hole 32 penetrating through the mounting plane are set at the center of the aluminum substrate 6 and the center of the mounting plane 31 of the lamp body respectively, a closing ring 51 of the driver board pierces through the through-hole 62 of the aluminum substrate and the through-hole 32 of the mounting plane from the inner cavity of the lamp body 3 so as to connect wires 9 on the driver board 5 to the aluminum substrate 6, a screw 7 is used to connect the aluminum substrate 6, the lamp body 3 and the base 2 together by screwing the screw into a screw hole 21 of the base, a reflector assembly 8 is welded in the center of a spherical cavity of the lamp cover 4 through ultrasonic welding.

In this embodiment, the reflector assembly 8 is composed of a reflector support 81 and a reflector 82 fastened to the reflector support 81. In another embodiment, the reflector assembly 8 is composed of a reflector support 81 and a reflector 82 integrally formed with the bottom of the reflector support 81.

In this embodiment, the reflector support 81 is composed of a small-diameter upper ring 811, a large-diameter lower ring 812, three poles 813 connecting the upper ring 811 and the lower ring 812, and a fastener 814 at the bottom of the lower ring 812 for fastening the reflector 82. The fastener 814 is composed of a protruding fastener 8141 which protrudes from an outer wall of the lower ring 812 and then narrows downwards and inwards into an acute angle.

In this embodiment, the reflector 82 is composed of a trumpet-shaped milky cover 821 and a hook fastener 822 arranged on an inner ring surface of an opening at the bottom of the cover 821 for fastening the fastener 814 of the reflector support.

The hook fastener 822 is composed of a U-shaped piece 8221, a groove 8222 formed within the U-shaped piece 8221 with its bottom having a shape in accordance with the shape of inner wall of the trumpet-shaped cover 821, and a hook 8223 formed at the top of the groove 8222 from the bottom of groove 8222 for fastening the protruding fastener 8141 therein.

While the preferred embodiments of the invention have been described above, it will be recognized and understood that various modifications may be made therein, and the appended claims are intended to cover all such modifications which may fall within the spirit and scope of the invention.

What is claimed is:

1. An LED light bulb emitting light rays in a downward direction comprising:

a lamp cap, a base, a lamp body and a lamp cover that being successively connected together to form an integration of them, a driver board received in an inner cavity of the lamp body, an aluminum substrate and an LED light source assembly arranged on the aluminum substrate both set on a mounting plane of the lamp body, a through-hole set at the center of the aluminum substrate and a through-hole set at the center of the mounting plane of the lamp body, a closing ring of the driver board piercing through the through-holes from the inner cavity of the lamp body so as to connect wires on the driver board to the aluminum substrate, and a screw screwed into a screw hole of the base so as to connect together the aluminum substrate, the lamp body and the base, characterized in that:

a reflector assembly is arranged in the center of a spherical cavity of the lamp cover the reflector assembly is composed of a reflector support, and a reflector fastened to the reflector support, wherein the reflector is composed of a trumpet-shaped milky cover, and a hook fastener arranged on an inner ring surface of an opening at the bottom of the cover for fastening the fastener of the reflector support.

2. The LED light bulb emitting light rays in a downward direction as claimed in claim 1, characterized in that: the hook fastener is composed of a U-shaped piece, a groove formed within the U-shaped piece with its bottom having a shape in accordance with the shape of inner wall of the trumpet-shaped cover, a hook formed at the top of the groove from the bottom of groove for fastening the protruding fastener therein.

3. The LED light bulb emitting light rays in a downward direction as claimed in claim 1, characterized in that: the reflector support is composed of a small-diameter upper ring, a large-diameter lower ring, a plurality of poles connecting the upper ring and the lower ring, and a fastener at the bottom of the lower ring for fastening the reflector.

4. The LED light bulb emitting light rays in a downward direction as claimed in claim 3, characterized in that: a transparent material is used for the reflector support; and three poles are provided.

5. The LED light bulb emitting light rays in a downward direction as claimed in claim 3, characterized in that: the fastener is composed of a protruding fastener which protrudes from an outer wall of the lower ring and then narrows downwards and inwards into an acute angle.

6. The LED light bulb emitting light rays in a downward direction as claimed in claim 1, characterized in that: the color of the cover is milky.

7. An LED light bulb emitting light rays in a downward direction comprising:

a lamp cap, a base, a lamp body and a lamp cover that being successively connected together to form an integration of them, a driver board received in an inner cavity of the lamp body, an aluminum substrate and an LED light source assembly arranged on the aluminum substrate both set on a mounting plane of the lamp body, a through-hole set at the center of the aluminum substrate and a through-hole set at the center of the mounting plane of the lamp body, a closing ring of the driver board piercing through the through-holes from the inner cavity of the lamp body so as to connect wires on the driver board to the aluminum substrate, and a screw screwed into a screw hole of the base so as to connect together the aluminum substrate, the lamp body and the base, characterized in that:

a reflector assembly is arranged in the center of a spherical cavity of the lamp cover;

the reflector assembly is composed of a reflector support and a reflector fastened to the reflector support;

the reflector support is composed of a small-diameter upper ring, a large-diameter lower ring, a plurality of poles connecting the upper ring and the lower ring, and a fastener at the bottom of the lower ring for fastening the reflector;

the reflector is composed of a trumpet-shaped milky cover and a hook fastener arranged on an inner ring surface of an opening at the bottom of the cover for fastening the fastener of the reflector support.

* * * * *